US006513430B1

(12) United States Patent
Atwater

(10) Patent No.: US 6,513,430 B1
(45) Date of Patent: Feb. 4, 2003

(54) VARIABLE WIDTH WEB INKING SYSTEM

(76) Inventor: Richard G. Atwater, 112 Smith Ave., Rockford, IL (US) 61107

( * ) Notice: Subject to any disclaimer, the term of this patent is extended or adjusted under 35 U.S.C. 154(b) by 40 days.

(21) Appl. No.: 09/722,910

(22) Filed: Nov. 27, 2000

(51) Int. Cl.[7] ..... B41F 31/02; B41F 27/10

(52) U.S. Cl. ..... 101/365; 101/350.1; 101/366; 137/625.48; 137/595

(58) Field of Search ..... 101/348, 349.1, 101/350.1, 350.2, 364, 365, 366, 367, 483, 484, 485; 137/625.18, 625.48, 594, 595, 625.5; 118/304, 429, 407

(56) References Cited

U.S. PATENT DOCUMENTS 4,281,597 A * 8/1981 Dressler ..... 101/365
5,575,208 A * 11/1996 Kirihara ..... 101/366
5,622,110 A * 4/1997 Orzechowski et al. ..... 101/148

* cited by examiner

*Primary Examiner*—Leslie J. Evanisko
(74) *Attorney, Agent, or Firm*—Vedder Price Kaufman & Kammholz

(57) ABSTRACT

An inking system for alternately supplying ink in two overall widths to a web press. The system includes ink pumps, a series of outlet passages for the ink pumps, a set of intermediate passages connected to the ink pumps, two outlet passages for each of its intermediate passages and first and second supply passages for an inking roller. There is an ink flow control that selects either a first or a second array of supply passages, thereby supplying ink in a wider width or a narrower width. One ink flow control, preferably, consists of two flat apertured plates and the other ink flow control comprises a piston and cylinder arrangement in a block having plural passages.

26 Claims, 4 Drawing Sheets

VARIABLE WIDTH WEB INKING SYSTEM

BACKGROUND OF THE INVENTION

The present invention relates generally to printing press inking systems, and more particularly, to a variable width inking system for such presses. By variable width is meant a system which is adapted to provide the same column inking for a press having two different widths, such as a width of 54" as well as a web of a 50" width.

In large scale printing, of the type commonly done with daily newspapers, the typical web width is 54". This width allows four pages of 13½" to be laid out. The ink is then supplied to such web by four page packs, that is, the page packs that are sufficient to ink all four pages. Each page then is subdivided into a plurality, usually eight, of individual columns, each serviced by one ink pump from a page pack. Each column of print customarily uses a somewhat different amount of ink, and that is the basic reason for having a page pack, i.e., eight (or six) separate ink pumps, each usually supplying a different amount of ink, per page. Such apparatus is consequently very common in the industry.

However, of late, there has been a tendency to reduce the width of a web of paper from 54" to 50". If the same press and basically the same inking system could be used for both 54" widths and 50" widths, changeover could be easily accomplished while maintaining high quality. Present day inking systems, however, are not satisfactorily able to accommodate both widths, and accordingly, such presses would require an all-new inking system, or an all-new inking system for each width.

However, according to the present invention, it is possible to accommodate a 54" web, and then, with a minimum amount of changeover effort, to accommodate a 50" web. According to the present invention, one way of doing this is moving a steering bar or "slider", between first and second positions. In effect, this slider is a valve body which, in conjunction with other elements of the inking system, will cause ink to flow from the page packs to the exactly correct width of paper. Another way is using a series of pistons to cause the passages for ink to change. In this section, a pneumatic source operates a piston for each ink pump, and the pumps then collectively service the wider or narrower web.

In the slider system, an inlet plate registers with a distribution plate which passes the ink through the steering bar in one or the other position thereof, and passes the ink to an ink-receiving plate before the ink is supplied to the inking rail for application to the inking roller. The simple addition of an ink distribution plate, a steering bar or slider, and a receiving plate are thus the only parts needed, and of these, only the slider need be moved. These then are the only parts that are necessary to render a press adaptable to inking both a 50" and a 54" width, for example.

Once the novel parts are in place, a mere movement of each half of the steering bar from one position to another is sufficient to ink either a 50" web or a 54" web satisfactorily, and accordingly, a single press with its same page packs may be made to ink either width of paper.

One of the most important parts of the inventive arrangement is an ink distribution plate which includes not only one passage for each inlet from the page pack, but also includes an elongated, generally inclined pocket for ink and two separate ink outlets for each pocket. Thus, the distribution plate can supply ink, for example, by either passing the ink straight through the distribution plate, or it may accommodate ink flow by passing the ink through the length of the pocket and to the second outlet in the other end of the pocket. Any other arrangement with pockets and/or passages will also be sufficient.

The ink is then directed from the opening in the opposite end of the distribution plate through the passages in the slider and then to the ink-receiving plate. A steering bar or slider made in two mirror-image pieces thus serves not only to open the passage of ink from whichever pocket is to be used, but also serves to block off the passage of ink through the other end of the pocket during that same time.

The pockets in the distribution plate are angled so as to be two inches narrower at each of their extreme ends, periodically taking on a less gradual inclination until the two are virtually straight, that virtually is perpendicular to the long axis of the distribution plate in the center thereof.

The pockets thus are arranged at a series of gradually increasing angles until they approach perpendicular at their half-way points, and then again are angled until they reach their extremes at the opposite end. The overall width of the distribution plate is approximately 60", but the pockets are spaced so as to encompass a 54" width in one position and a 50" width in the other. The thirty-two spaces typically provided are proportioned equally.

The steering or slider bar is a flat plate which may be made in two sections so that each is movable toward and away from the center. An illustration will be given of a 54" web width vs. a 50" web width. However, other variations or web widths may be made, provided the ink distribution plate and the steering bar are made of appropriate dimensions. Only one ink inlet plate is required, but the other three plates, namely, the distribution plate, the steering bar and the ink-receiving plate must have two sets of ink passages or holes drilled in them for each ink inlet.

In the piston cylinder system of changing the configuration of ink passages, the ink flows from the outlet of each pump in the page pack to a cylinder block having for example 32 (or 24) pistons. The cylinder block has one inlet for each pump, and has two outlets for each inlet, one series of outlets is for the wider web and one for the narrower web. The pistons are pneumatically operated, and all operate together within the block.

The block is affixed to a collection body, and this body collects the ink and causes it to change direction and flow to a very narrow area—a thin slot—between an upper orifice plate and a lower orifice plate, from which it is applied to the inking roller. The pistons are properly sealed and operate in response to air pressure either above or below them.

It would be an advantage if a series of page packs, for example four, could be made to serve a pair of different web widths while still maintaining the same column-to-inking unit correspondence. Hence, it is an object of the invention to have one or more page packs, either electrical/electronic or mechanical, each serving a set of columns, with the width of such columns, and hence the width of the web, being varied without the necessity of changing the page packs.

Another object of the invention would be to provide a simple system characterized by interchanging the manner in which the inking rail receives its ink.

Yet another object of the invention is to provide a series of pockets, each of varying angular orientation and each having an outlet at each end, such outlets being alternately called on to supply two different sets of inking rail inlet passages in the press.

Still another object of the invention is to provide a steering bar or slider, preferably a two-piece unit, which serves to close off one set of openings or passages in the ink distribution plate and open the other set of openings or passages in the plate by a simple movement of one or two parts of the steering bar or slider from one position to another position.

A further object of the invention is to provide an integrated ink system, including an ink inlet plate, an ink distribution plate, an ink steering bar and an ink-receiving plate, all which make up a compact subassembly for insertion into an existing printing press to convert the same to a dual width web press.

A still further object of the invention is to provide a method of altering the width of web served by the press while retaining the same page pack or page packs in their same orientation and without change.

An additional object of the invention is to provide a simple method of adapting the same page pack or packs to a dual width system without making other changes to the press.

Another object of the invention is to provide an alternative mechanism for achieving the same result, i.e., providing ink to either a 54" or a 50" web, without great expense or inconvenience and in a short time.

A still further object of the invention is to provide a series of pistons to perform the switching action in question.

Yet another object of the invention is to provide a series of pistons which are fluid operated, especially by air, and which may move rapidly to alter the ink flow.

An additional object of the invention is to provide an ink distribution system, including a cylinder block having plural cylinders, plural inlets and two outlets for each inlet, pockets for each outlet and a collection body having inlets for each pocket, with the collection body having plural passages leading to a region between orifice plates.

The invention achieves its objects and other objects and advantages by providing an inking system which includes a single ink inlet plate, a distribution plate containing a plurality of pockets, with two outlets for each pocket, most or all of which are angled, a steering bar preferably made in two pieces, having openings registering with the openings on both ends of each pocket, and an inking rail containing two inlets for each pocket, with the steering bar being made moveable so as to open one end of the pocket or the other to passage of ink therethrough, and block off the other ends of the pockets. The inking rail thus can receive ink from either of two outlets in each pocket, and may ink the appropriate web width accordingly. The system also works with a multi-cylinder block, pistons in each cylinder movable between two positions, a plurality of ink inlets, two outlets for each inlet and a collection body with plural passages, all leading to a region between orifice plates to which region the ink is supplied.

The manner in which these and other objects of the invention are achieved in practice will become more clearly apparent when a reference is made to the following detailed description of the present invention and shown in the accompanying drawings in which like reference numbers indicate corresponding parts throughout.

DESCRIPTION OF THE PREFERRED EMBODIMENTS OF THE INVENTION

Figure 1:
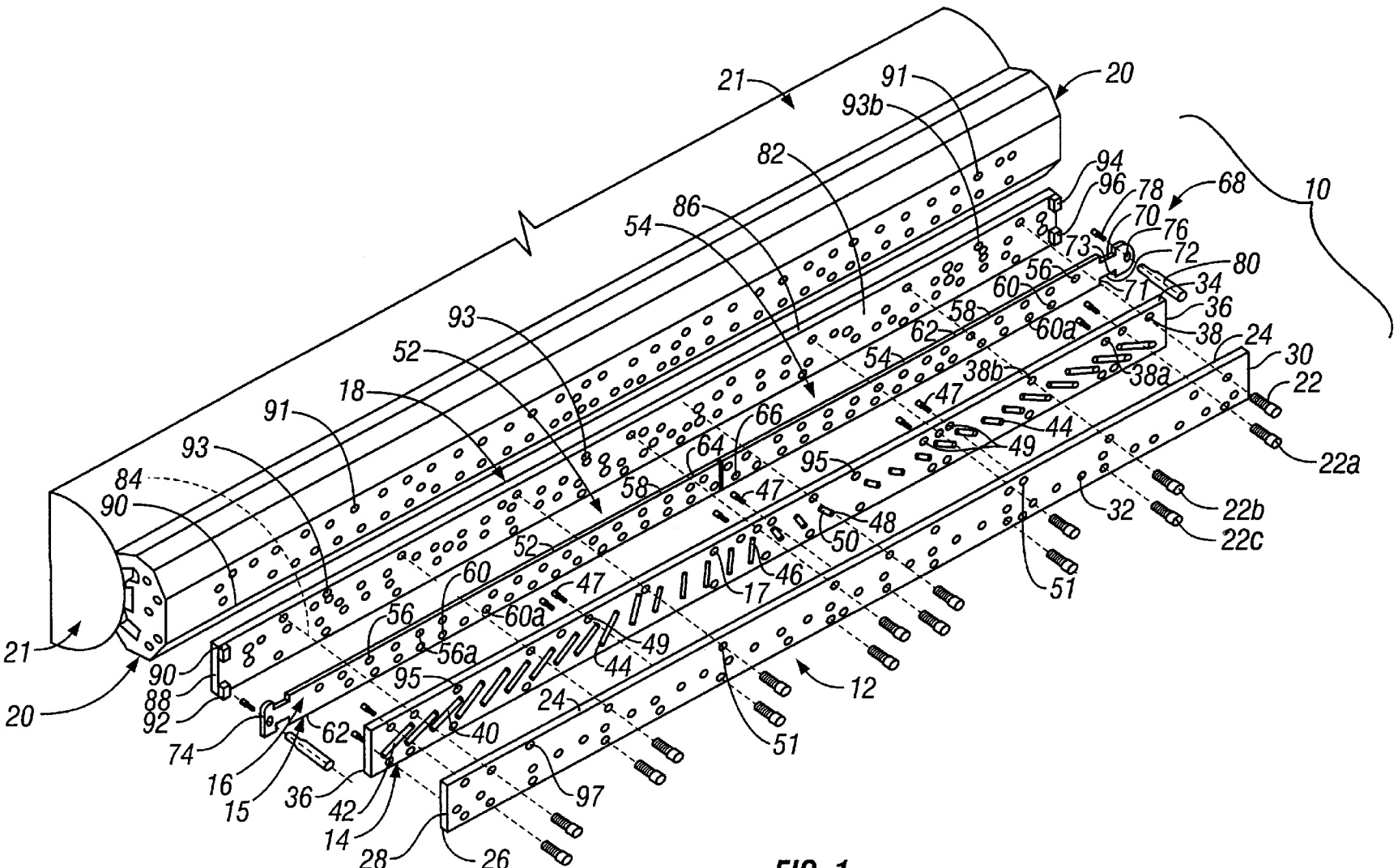
FIG. 1 is an exploded perspective view, with portions broken away, of the various plates, including the distribution plate, the slider or steering bar and inking rail of the inking system of the present invention.
Figure 2:
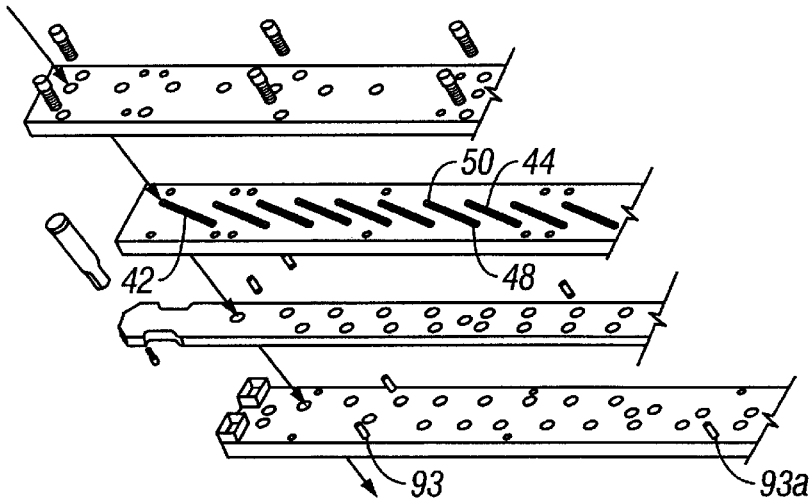
FIG. 2 is a perspective view of the ink-receiving plate, the distribution plate and the slider or steering bar of the invention in one position of use.
Figure 3:
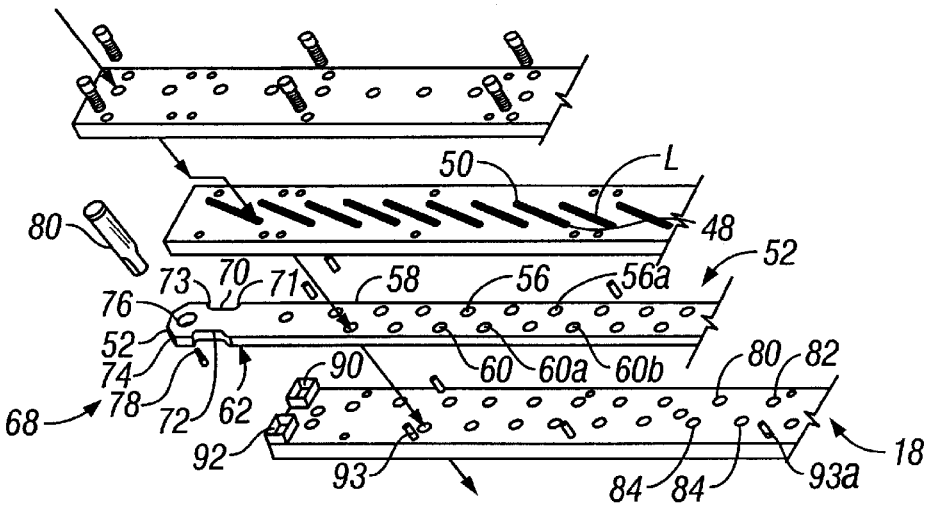
FIG. 3 is a perspective view of the plates and slider of the invention in another position of use.
Figure 4:
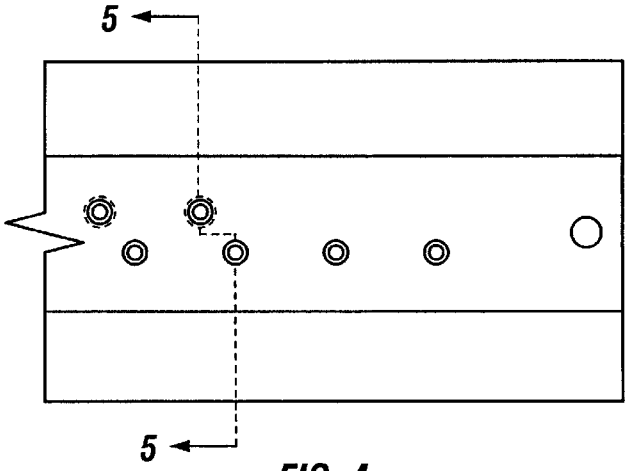
FIG. 4 is an enlarged plan view of a portion of the ink rail of the invention.
Figure 5:
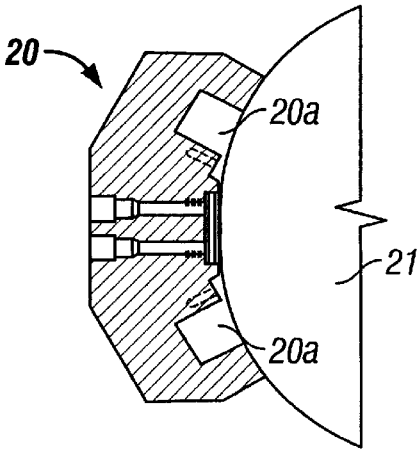
FIG. 5 is an enlarged, vertical sectional view of the ink rail and a portion of the inking roller.

Although the invention may be embodied in different forms and may differ in the mechanism of the steering bar or in other detail, a detailed description will be given of two of the preferred embodiments of the invention wherein the combination is made of a few different units comprising the novel inking systems.

Referring now to FIGS. 1–5 in greater detail, an inking system generally designated 10 includes an ink inlet plate generally designated 12, an ink distribution plate generally designated 14, a two-piece steering bar or slider generally designated 16, 16*a*, and an ink-receiving plate generally designated 18. The ink inlet plate is operably connected, directly or indirectly, to a plurality of page packs (not shown), whose construction and operation is known to those skilled in the art and whose construction and operation are shown, for example, is U.S. Pat. No. 5,472,324.

Specifically, the ink inlet plate 12 includes a plurality of fasteners 22, 22*a*, etc., used to link the five elements in the inking system 10 together. Ultimately, these plates are attached to an inking rail generally designated 20, which surmounts and lies in close proximity to an inking roller generally designated 21.

Referring again to the inking system 10, the ink inlet plate 12 includes approximately sixteen of the fasteners 22, 22*a*, 22*b*, 22*c*, etc., arranged in two columns, which are disposed lengthwise of the ink inlet plate 12. These generally are arranged about the periphery of the plate and are shown to be countersunk in the plate 12. The shanks of the fasteners 22, 22*a*, etc., extend downwardly through the plates 14, 18 a substantial distance for fastening the inking system together in a leakproof manner.

The ink inlet plate 12 includes a pair of thin side edges 24, 26 and a plurality of opposed end edges 28, 30. In the preferred embodiment, this plate is 0.375" thick, and the countersink is preferably 0.0625". The plate 12 includes a plurality of openings 32 for ink, and these may be offset from the center line of the plate 12 typically a distance of 1.568" measured from the edge. The plate is preferably 2½" wide and 55" long. These dimensions are selected for the shown embodiment but are only illustrative of the invention.

The distribution plate 14 is a key element of the combination, and is a flat, somewhat thicker plate that includes side edges 34 and end edges 36, and preferably has a thickness of about 0.875". Openings 38, 38*a*, 38*b*, etc. are provided for the shanks of the fasteners 22. In addition, an important part of the invention are the plurality of ink-receiving pockets 40 formed in the distribution plate.

In the preferred form, there are thirty-two such pockets, and they are generally arranged in a fan-shaped pattern, that is with those of the greatest inclination with respect to the long axis of the plate lying at the outer extremes and gradually being arranged so as to approach perpendicular to the side edges 34 of the plate in the middle of the distribution plate. Thus, a typical end pocket 42 is relatively long and of a slight inclination from the side edge 34 of the plate. An intermediate pocket, such as the pocket 44, has a moderate, say 45° inclination with respect to the side edge 34 and corresponding medium length, while the pocket 46 is virtually perpendicular to such edge 34 and is the shortest.

Each of the pockets importantly includes a pair of openings 48, 50 at each end thereof, which extend all the way through the plate. Each pair of openings is joined by a passage of a suitable cross-section and which is preferably, for ease of manufacture, open at the top. The depth of the pocket is such that it renders the pocket of at least equal cross-section to the cross-sectional area of the openings 48, 50. Thus, the ink will tend to flow readily through either pocket.

A plurality of fasteners 47 are provided for extending up through openings 49 in distribution plate 14 and thence into tapped opening 51 in the inking plate 12. These parts 12, 14 do not readily come apart in use.

The steering bar or slider 16 comprises two parts, a left-hand part 52 and a right-hand part 54. By way of example, the bar is of 0.250" in thickness and 1.5" in width. The steering bars or sliders 52, 54 are identical except they are mirror-images of each other. Therefore, only the left-hand steering bar 52 will be described in detail, with the construction of the right-hand bar being the same except that it is mirror-imaged. This steering bar includes a plurality of openings 56, 56*a*, etc. which are disposed parallel to and close to one side edge of the unit 58, while another plurality of openings 60, 60*a*, etc. are disposed parallel to the opposite side edge 62 and close to this edge 62. An axially inner end edge 64 is closely spaced from the other inner end edge 66 of the other element 54 when the slider halves are in the closed position, and are spaced apart in the open position.

Referring now to the left-hand end of the left-hand steering bar 52, this includes a contoured end portion generally designated 68 having a pair of opposed notches 70, 72 with shoulders 71, 73 thereon. Additionally, the end portion 74 has an opening 76 therein for a fastener 78.

The right-hand bar 54 includes identical, mirror-imaged parts which are not described in detail. It is sufficient to say that there are, in one position of the steering bar 16 an alignment of one set of openings 56 with the openings 48 in the distribution plate. The remainder of the openings 60, 60*a*, etc. very importantly align with solid portions of the distribution plate and hence do not permit ink flow therethrough when the slider is open to ink passage through the openings 48, 56.

When the left-hand portion of the slider is moved to the left, and the right-hand portion to the right a desired distance, the opposite situation obtains. There are blind passages for the set of openings 50, etc. in the distribution plate, so no ink flow is permitted, and the ink then flows through the opposite set of openings, 60, 60*a*, etc. The shoulders 71, 73 on the notches 70, 72 engage the square formations 90, 92 and 94, 96 and these shoulders limit the travel of the sliders 52, 54 and insure that the sliders 52, 54 are exactly aligned whether in or out.

In any case, the ink thus flows into the ink-receiving plate 18, or more specifically, to either the set of openings 82 in the one case or the openings 84 in the other case.

An ink-receiving plate 18 rests atop (or is formed integrally with) an ink rail 20, and the ink rail in turn is separated only by a working clearance from the ink roller 21. The ink-receiving plate 18 in turn is defined by longitudinal or side edge portions 86 and transverse or end edge portions 88. Preferably, it is 2.5" in width and 0.375" in thickness. As pointed out, the ends include square formations 90, 92, 94, 96 for engaging shoulders 71, 73 on the notches 70, 72 to locate and limit the travel of the steering bars to either end. The formations 90, 92, etc. preferably have a height of 0.25".

Consequently, in one position of the slider, namely, the out position, the ink has passed downwardly through the openings 32 in the plate 12 to the pocket 42 through the opening 48, through the opening 60 in the steering bar and into the opening 84 in the ink-receiving plate 18. From here, the ink passes out to the inking rail 20 which is disposed immediately beneath the plate 18, and thence to the cavity 20*a* within the ink rail and ultimately to the inking roller 21.

With the movement of the slider in, the ink passes through the same openings in the upper plate, but in the distribution plate, the ink passes through the length of the pocket 42 and out the opposite end 50, through the opening 56 in the steering bar and thence into a suitable opening 82 in the ink-receiving plate 18 before passing into the cavity 20*a* in the inking rail 20.

Hence, it is merely a matter of sliding the steering bars away from or toward each other for changing the press from using a 50" web to using a 54" web.

As pointed out above, the slider is preferably made in two sections to facilitate the movement toward either side of the angled pockets. Each end 74 of the slider as shown includes an opening therein for receiving a fastener 78 for a grasping bar 80. The grasping bar may be grasped by the user's hand and simply pulled (or pushed) to the maximum permitted by the formations 90, 92, etc.

The fasteners 22, 22*a*, 22*b*, etc. have a length such that they extend through the ink inlet plate, the distribution plate, and the ink-receiving plate as well as the inking rail but not the sliders 52, 54. Once the fasteners have passed through the openings for the fasteners 22, 22*a*, etc., through the openings 38 in the distribution plate and through the openings 91 in the inking rail 20, all of the parts of the combination, including the sliders, may be held down in ink-tight relation.

When it comes time to move the sliders in or out, it is only necessary to slightly release the compressive force on the various plates of the inking system so that the sliders are able to be moved. After the slider is moved to its new position, the fasteners are simply tightened down sufficiently so that there is no ink leakage between them and any adjacent plate in the stack of plates. Dowel pins 93, 93*a* are provided for registration with openings 95, 97 so as to align the various parts of the stack before they are assembled and help prevent sidewise movement of the steering bars or sliders 52, 54. The stack 10 may be loosened to readily move the sliders without completely undoing the stack 10. These dowel pins 93, 93*a*, etc., also prevent sideways movement of the sliders by closely surrounding them. The formations 90, 92, etc. are pinned in place and then screwed into position.

Referring now to the materials used for construction of the various plates, etc. Any suitable metal material may be used. However, in the preferred embodiment the ink inlet plate, the ink distribution plate, are preferably made from a hard aluminum in the dimensions referred to in the specification. However, it is preferred that the steering bar or slider be made from stainless steel sheet material, since it moves with regard to each of the ink-receiving plate and the ink-distribution plate, it is desirable not to have these elements made from the same material. The ink inlet plate and the ink distribution plate are customarily fastened together and these two elements do not move with respect to each other even though the slider may be moved.

Hence, in use, the ink-distribution plate and the ink inlet plate are moved as a unit a sufficient distance to allow the sliders to be removed in each direction with respect to the ink-receiving plate. However, since the formations 90, 92, etc. on the ink-receiving plate are preferably 0.250", and opening a distance somewhat less than that, say of 0.125" is preferred, and this clearance is all that is necessary to permit movements of the sliders before refastening the entire stack. Consequently, a turn or two of the fasteners in the form of Allen head cap screws 22, 22*a*, etc. is all that is necessary since the other fasteners, including the alignment dowel pins, insure that the stack need not be taken apart or put back together. Thus, the matter of changing the web width is simple as possible and required only an Allen wrench and a very short time.

Figure 6:
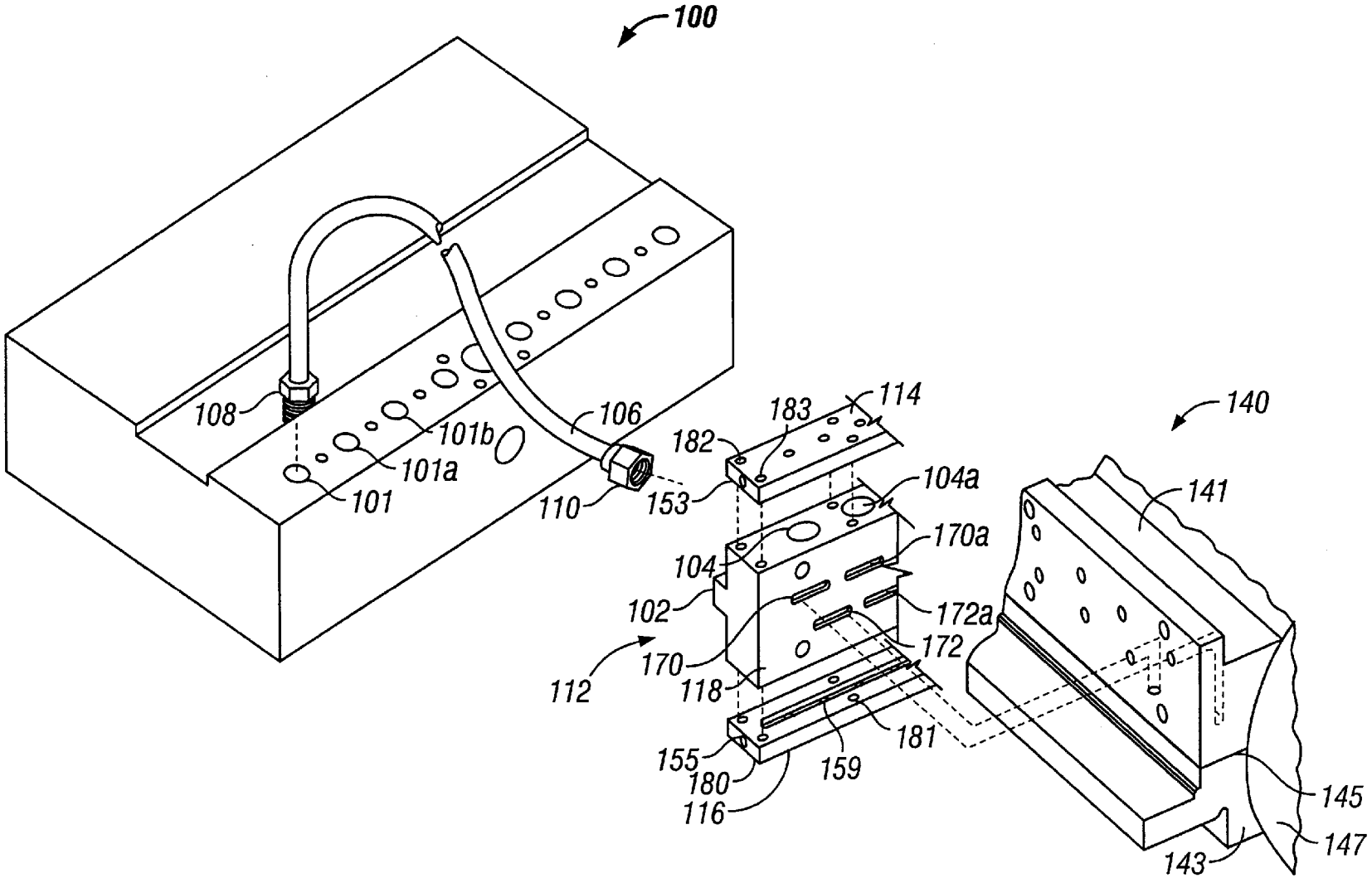
FIG. 6 is an exploded view, partly diagrammatic in character, showing the page pack, a conduit, and portions of the cylinder block and orifice plates of the invention; and, FIG. 7 is a greatly enlarged vertical sectional view of the cylinder block, the piston and the various ink passages used in another embodiment of the invention.
Figure 7:
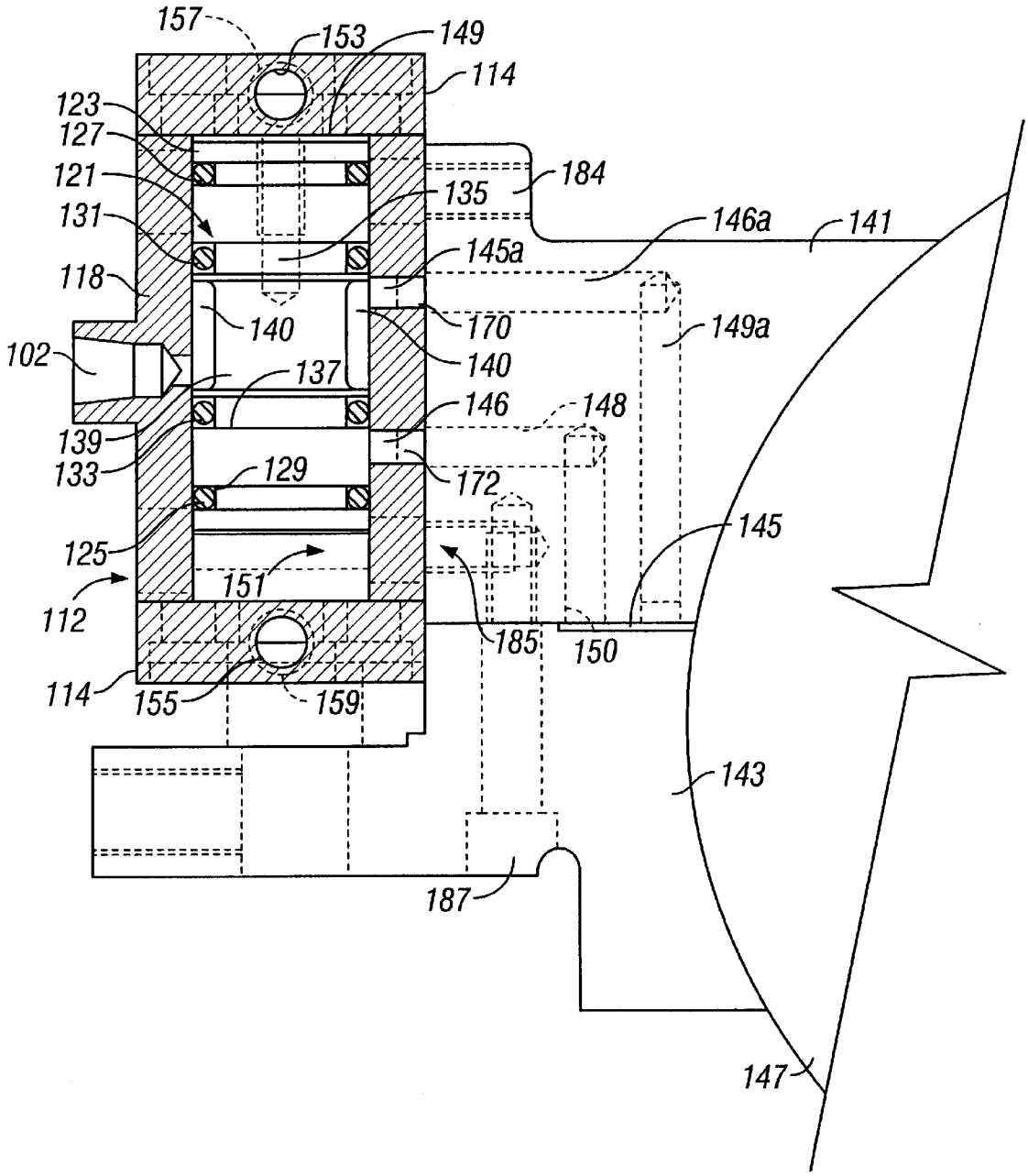

Referring now to FIGS. 6 and 7 and to another embodiment of the invention, there is shown an alternate form of inking apparatus, which differs in the manner in which the ink is diverted into separate passages which are spaced close together or farther apart. In FIG. 6, there is shown one page pack generally designated 100, one representative hose 106 for supplying ink from the page pack 100, a cylinder block generally designated 112 with various parts including top and bottom covers 114, 116. The drawing also shows an assembly 140 including upper and lower orifice plates 141, 143 with a slot 145 therebetween for inking a roller generally designated 147.

In this apparatus, the page pack 100 is somewhat schematically shown as having eight outlets, 101, 101*a*, 101*b*, etc. one for each cylinder. It is understood that the page pack may hold six outlets, however. The exact number is not important except that there should be the same number of passages 102, as there are cylinders 104, 104*a*, etc. in the block 112.

The page packs are connected by the series of ink lines or hoses 106 which have fittings 108, 110 on each end thereof. These fittings extend to and are fastened in fluid-tight relation with counterpart receivers (not shown) in the cylinder block assembly 112.

The cylinder block assembly 112 is shown to include a top cover 114, and a bottom cover 116, for purposes which will be disclosed, as well as the cylinder block 118 itself.

Within each cylinder block there are a plurality (preferably 16) of double acting, double-headed pistons generally designated 121 (FIG. 7) which serve as valves for the ink. The pistons each include two heads 123, 125 which in turn include sealing rings 127, 129 as well as O-ring seals 131, 133 received in grooves 135, 137. The skirt portion 139 of each piston includes a relief 140 extending all the way around each piston. This relief or passage 140 registers with one inlet passage 102 and either of two outlet passages 145*a*, 146, but not both, depending on whether it is in the "up" or "down" position. Each piston 121 includes a headspace 149, 151 above and below the piston 121 to accommodate air supplied alternately to the passages 153, 155 and from there to the pockets or troughs 157, 159.

The passages 145, 147 have outlets that register with the horizontal passages 146, 148 and the horizontal passages 146, 148 register with the vertical passages 149*a*, 150 in the upper orifice plate 141. Both vertical passages 149*a*, 150 end at the narrow region 145 between the plates 141, 143.

A key feature of this embodiment is that whereas all the pairs of outlet passages 170, 170*a* etc. from the cylinders 104, 104*a*, etc. are vertically aligned, the horizontal portions 146, 148 of the passages are not laid out along the same vertical center lines. This is because the upper orifice plate 141 has its inlets 141*a* offset from a centerline by varying distances, and the ink path includes pockets 170, 172 to match the ports or passages 145*a*, 146*a* with the passages 146*a*, 148. These pockets 170, 170*a*, etc. and the pockets 172, 172*a* are of varying length depending on their position within the orifice plate 141. An illustration of one set of ports and their alignment is shown in FIG. 6, with the dotted lines indicating the paths taken by the ink in going from the cylinder block 112 to the upper orifice plate 141.

Referring again to FIG. 7, there are fasteners 180, 181, 182, 183 to secure the top and bottom covers 114, 116 to the cylinder block 112. In addition, there are fasteners 184, 185 which fasten the cylinder block to the upper orifice plate, and there are also a plurality of fasteners 187 which fasten the upper orifice plate to the lower orifice plate. These are all arranged so as to create fluid-tight connections between these various parts, except of course, for the ink slot 145.

In use, either the upper trough 149 is pressurized by passing pressurized air through the port 153. The presence of this pressure in the trough or channel 149 urges the piston 121 downwardly, registering the inlet port 141 in the piston 121 and ultimately with the passage 147. The passage 147 is connected via the pocket 172 and from there to the passage 148 which communicates with the vertically extending passage 150. From here, the ink is deposited in the area 145 between the upper and lower orifice plates 163, 165.

When the pressure is switched, it goes through the bottom port 155 and then along the bottom trough 159 for the entire length of the block 112. Thus, it acts on all the pistons 121. Here, the pressure acts on the bottom of the piston in the head space 151 and pushes the piston upwardly, registering the port 102 with the upper port 145*a*. After the ink passes through the pocket 170, it is offset somewhat by reason of the pockets and is registered with the passage 146*a* and 149*a*, exiting again in the same area 145 between the orifice plates 141, 143. The pistons are all actuated at the same time and extend either up or down, since the air pressure supply can pressurize only one port at a time. The two embodiments are merely illustrative of the forms the invention may take. The embodiments have in common that the valve means, in one case, comprises a slider or steering bar or what may alternately be termed a "selector" so as to permit the ink to flow through one of two sets of passages but not both. In the other embodiment, the pistons move between first and second positions to accomplish this goal. In the first embodiment, the ink distribution plate and the slider cooperate to control the flow of ink from one set of passages to the other. This is preferably done by reason of the plurality of pockets, each one shaped so as to have an increasing or decreasing angle with respect to the long axis of the plate.

In the second embodiment, the convenient way to accomplish this is to have the cylinder block bored with the two outlet passages for each piston bore being vertically aligned. In this embodiment, a plurality of pockets are formed transversely in the cylinder block, in respect to an imaginary vertical line, the pockets being of the greatest width at the outer extremes of the cylinder block, with the length of the pockets gradually decreasing as the cylinder bores approach the middle of the block, and then gradually increasing as the bores approach the other end.

This method is preferable to having the cylinder block bored with various angled passages. In both cases, however, the upper orifice plate has the upper set of passages substantially equally spaced and spanning the 54" width, and the lower passages also equally spaced but spanning a 50" width, for example.

Other methods and structures may conceivably be used, but the suggested method is presently considered the best, with the piston type controller requiring no tool work such as releasing any connections or the like with the possibility of leakage. However, the first embodiment is more preferable in the interest of lower cost.

An important factor in both embodiments is the formation of the pockets. These serve functionally in one embodiment to align the ink inlet plate with the appropriate passages in the inking rail, and in another embodiment, to align the ink outlet passages in the block with either of the sets of passages in the ink orifice plate.

It will thus be seen that the present invention provides an apparatus and method for having a wide web width press converting easily to a somewhat reduced width web press and still keeping the desired page-pack to column ratio, all without changing page packs or other related apparatus, having a number of advantages and characteristics including those expressly pointed out here, and others which are inherent in the invention. Two illustrative embodiments of the invention having been shown and described in detail, it is anticipated that variations to the described form of apparatus and method will occur to those skilled in the art and that such modifications and changes may be made without departing from the spirit of the invention, or the scope of the appended claims.

What is claimed is:

1. An inking system for supplying ink in two overall widths to a web press, said system including a series of ink pumps forming parts of page packs, a series of outlets for said ink pumps, a plurality of intermediate passages connected to said pump outlets, two outlet passages for each of said intermediate passages, first and second arrays of supply passages for an inking roller, first and second arrays of outlet passages communicating alternately with said supply passages, with said first array of supply passages feeding ink to a reduced width web and said second array of supply passages feeding ink to an increased width web, and an ink flow control movable between first and second positions, said first position allowing ink to flow through said first array of supply passages and cutting off ink flow to said second array of supply passages, and said second position allowing ink to flow through said second array of supply passages and cutting off flow through said first array of supply passages, said supply passages each being arranged to feed a particular portion of an inking roller, whereby said ink may be supplied in a relatively wider overall width or in a relatively narrower overall width of web in a printing press.

2. The inking system as defined in claim 1, wherein said ink flow control comprises at least one slidable member having plural ports therein, said first array of ports being registered with said supply passages for said wider width web and said second array of ports being registered with said supply passages for said narrower width web.

3. The inking system as defined in claim 2, wherein said ink flow control comprises first and second slidable members, said first slidable member being slidable in one direction and said second member being slidable in the opposite direction.

4. An inking system as defined in claim 3, wherein both of said slidable members are in the form of flat plates.

5. The inking system as defined in claim 3, wherein said inking system includes a flat plate support, said plate support including raised formations on the extreme ends of said plate support, said slidable members comprise two flat plates, said flat plates having notched portions for engaging said raised formations to limit the travel of said flat plates in either direction and to assure alignment of said ports with said outlet passages and said supply passages.

6. The inking system as defined in claim 3, wherein said slidable members comprise flat plates, and wherein each flat plate includes a handle to facilitate grasping and movement of said plates.

7. The inking system as defined in claim 1, wherein said ink control comprises a cylinder block and a plurality of pistons reciprocable in said cylinder block, said pistons acting as valves to control the flow of ink.

8. The inking system as defined in claim 1, wherein said ink flow control includes a cylinder block and a plurality of pistons reciprocable in said block, said first array of outlet passages and said second array of outlet passages being aligned vertically in use, said pistons each including plural pockets extending to opposite sides of said outlet passages and a relieved portion communicating with said first or second array of supply passages.

9. The inking system as defined in claim 8, wherein said first array of supply passages and said second array of supply passages are formed in an orifice plate, said first and second array of supply passages being offset from each other so as to be aligned with said outlet passages.

10. An inking system for supplying ink in two overall widths to a web press, said system including an ink inlet plate having a plurality of inlet passages defining a first overall width and lying parallel to a side edge of said ink inlet plate, an ink distribution plate having a plurality of pockets aligned with said inlet passages, with outlet passages near first and second ends of each of said pockets, said pockets being angled to varying degrees in respect to a longitudinal edge of said distribution plate, and said outlets being arrayed so as to place the overall width of a pattern of ink passing through said system to said first overall width or to a reduced overall width, at least one steering plate movable along the long axis of said steering plate between two positions, so as in one position to provide a plurality of passages of said first overall width for ink passing from said outlets on said first end of each of said pockets, and to prevent ink flow through said outlets on said second end of said pockets, and in another position of said ink distribution plate, to provide a plurality of passages of a reduced overall width for ink passing from said outlets on said second end of said pockets, and to prevent ink flow through said passages in said first end of said pockets, and an ink-receiving plate containing passages of said first width or said reduced width for ink passing through said first or second passages in said ink receiving plate, and an inking rail including at least one ink-receiving cavity of a greater or lesser width, depending on the position of said passages in said steering plate.

11. The inking system as defined in claim 10, wherein said at least one steering plate comprises two steering plates.

12. The inking system as defined in claim 11, wherein said steering plates are configured to move longitudinally toward and away from each other.

13. The inking system as defined in claim 11, wherein said ink inlet plate and said ink distribution plate are fastened to each other to make a single unit and wherein said single unit and said ink-receiving plate sandwich said steering plate between them, said single unit and said ink-receiving plate being held together by fasteners which do not extend through said steering plate, whereby when said fasteners are loosened, said steering plate may not be moved, and when said fasteners are tightened, said single unit, said steering plate and said ink-receiving plate are held together as a unit.

14. The inking system as defined in claim 11, wherein said ink-receiving plate includes raised formations on each of two ends of said ink-receiving plate, said formations engaging a pair of notches in said steering plates to limit the in-and-outward travel of each of said steering plates.

15. The inking system as defined in claim 11, wherein one end of each of said steering plates includes a handle for grasping and pulling or pushing each of said steering plates to a desired position.

16. An inking system for supplying ink in two overall widths to a web press, said system including a series of ink pumps forming parts of page packs, a series of outlets for said ink pumps, a cylinder block having plural piston receiving bores, and an ink inlet passage for each pump outlet, two outlet passages for each of said inlet passages, plural pistons, one piston for each bore in said cylinder block, two arrays of supply passages, one array of said supply passages being connected so as to feed ink to a reduced width web and the other array of said supply passages being connected so as to feed ink to an increased width web, said pistons in said bores being responsive to fluid pressure and movable between first and second positions, said first position allowing ink to flow through said first array of passages and cutting off ink flow to said second array of passages, and said second position allowing ink to flow through said second array of passages and cutting off flow through said first array of passages, said passages each being aligned with a given portion of an inking roller, whereby said ink may be supplied to a relatively wider or relatively narrow web width in a printing press.

17. The inking system as defined in claim 16, wherein said pistons comprise double ended pistons adapted to move up or down in response to fluid pressure supplied from above or beneath said pistons.

18. The inking system as defined in claim 16, wherein said pistons each includes O-rings forming a seal and said ink being confined between said O-rings.

19. The inking system as defined in claim 16, wherein said pistons each include a central skirt portion of reduced diameter allowing ink to pass past said pistons without substantial restriction to ink flow.

20. The inking system as defined in claim 16, wherein said cylinder block includes top and bottom covers, said covers forming parts of enclosed regions allowing fluid to enter and exit whereby said pistons may move up and down in their bores.

21. The inking system as defined in claim 16, wherein said fluid pressure is air pressure.

22. The inking system as defined in claim 16, wherein said cylinder block includes first and second arrays of outlet passages aligned vertically in use, said cylinder block including plural pockets in said block, said plural pockets extending to opposite sides of said outlet passages and communicating with said first or second array of supply passages.

23. The inking system as defined in claim 16, wherein said first and second arrays of supply passages are formed in an orifice plate, said first and second array of supply passages being offset from each other so as to be aligned with said outlet passages.

24. A method of changing an ink flow from a plurality of page pack ink pumps spaced apart a given overall width to a first overall width and to a second slightly narrower overall width without altering an established spacing interval of the pumps, said method comprising allowing said ink to flow from said plurality of ink pumps through an ink flow control apparatus which maintains said spacing interval established by said ink pumps and then shifting said ink flow control apparatus so as to have a narrower spacing interval than said established interval spacing, thereby using said pumps of said page pack to perform inking a wider web and a narrower web without changing the distance between pumps.

25. The method as defined in claim 24, wherein said ink flow control apparatus includes an ink inlet plate, an ink distribution plate with a pocket for each inlet and two outlets from each pocket, a steering bar movable between two positions and, in one position having a first array of outlets registering with a first array of inlets at a given overall width in said ink receiving plate and in a second position having a second array of outlets registering with a second array of inlets at a narrower overall width in said ink-receiving plate, whereby moving said steering bar between positions alters the overall width of an ink pattern.

26. The method as defined in claim 24, wherein said ink flow control apparatus includes a block having a plurality of cylinders with cylindrical openings therein, plural inlets for ink into said cylinders, one inlet for each cylinder, an upper outlet and a lower outlet in said cylinder block for each inlet, said outlets being vertically aligned along a center line, a pocket for each outlet, said pockets being directed respectively toward and away from a center line on which said outlets are aligned, at least one orifice plate having one array of inlet passages for the upper outlets and one array of inlet passages for the lower outlets, and a plurality of pistons, one for each cylinder, said pistons being reciprocable between a first position whereby said inlets are in communication with said first array of outlet passages and a second position whereby said inlets are in communication with said second array of outlet passages, said array of outlet passages in said orifice plate being spaced apart by a given overall width and by an overall width that is narrower than said given overall width.

* * * * *